US011207240B2

(12) United States Patent
Chen

(10) Patent No.: US 11,207,240 B2
(45) Date of Patent: Dec. 28, 2021

(54) DRUG MIXING CONTAINER

(71) Applicant: JIERYANG BIOTECH, INC., Taichung (TW)

(72) Inventor: Chih-Fu Chen, Taichung (TW)

(73) Assignee: JIERYANG BIOTECH, INC., Taichung (TW)

( * ) Notice: Subject to any disclaimer, the term of this patent is extended or adjusted under 35 U.S.C. 154(b) by 72 days.

(21) Appl. No.: 16/419,375

(22) Filed: May 22, 2019

(65) Prior Publication Data

US 2020/0368110 A1 Nov. 26, 2020

(51) Int. Cl.

*B65D 81/32* (2006.01)
*A61J 1/20* (2006.01)
*B01F 15/02* (2006.01)

(52) U.S. Cl.

CPC ..... *A61J 1/2089* (2013.01); *A61J 1/201* (2015.05); *A61J 1/2017* (2015.05); *B01F 15/0212* (2013.01); *B65D 81/3211* (2013.01); *B01F 2215/0032* (2013.01)

(58) Field of Classification Search

CPC ..... B65D 81/3211; B65D 81/325; B65D 81/3255; B65D 81/32; B65D 25/08; A61J 1/2089; A61J 1/201; A61J 1/2017
USPC ..... 206/222, 219
See application file for complete search history.

(56) References Cited

U.S. PATENT DOCUMENTS 4,682,689 A * 7/1987 Pereira ..... B65D 81/3211 206/222
5,370,222 A * 12/1994 Steigerwald ..... B65D 81/3205 206/219
6,726,005 B2 * 4/2004 Lentine ..... A61C 5/66 206/222
7,896,155 B2 * 3/2011 Seelhofer ..... B65D 51/2835 206/222
8,784,917 B2 * 7/2014 Sebban ..... A23L 35/00 426/120
2011/0180545 A1 * 7/2011 Marino ..... B65D 81/3211 220/568
2015/0353249 A1 * 12/2015 Muir ..... B01L 3/502 206/222

* cited by examiner

*Primary Examiner* — Steven A. Reynolds
(74) *Attorney, Agent, or Firm* — Muncy, Geissler, Olds and Lowe, P.C.

(57) ABSTRACT

A drug mixing container is provided. The drug mixing container includes a container with an opening facing upward and a cover body. An inner peripheral wall of the container includes at least one piercing structure protruding toward the opening of the container. The cover body accommodates a drug and includes a sealing film for sealing the drug in the cover body. In use, when an opening of the cover body is coupled downward to the opening of the container, the sealing film is pierced and torn by the piercing structure to make the drug in the cover body flow into the container, thereby preventing hands of an operator from being stained with the drug.

2 Claims, 9 Drawing Sheets

DRUG MIXING CONTAINER

BACKGROUND

Technical Field

The present invention relates to a container for preserving a specimen, and more particularly, to a drug mixing container. A cover body contains a drug such as a specimen preservation solution and is sealed by a sealing film. An inner peripheral wall of the container includes a piercing structure. When the cover body is screwed with the container, the sealing film of the cover body may be pierced and torn, so that the specimen preservation solution in the cover body flows into the container, and then a specimen is immersed in the specimen preservation solution.

Related Art

Nowadays, a conventional container for preserving a specimen generally includes a container such as a plastic cup and a cover body screwed with the cup. In this way, an opening at a top of the cup is sealed to allow a specimen to be placed and preserved in a sealed container. Because the specimen needs to be immersed in a specimen preservation solution such as formalin for preservation for a considerable period of time, when the specimen is placed in the cup, an appropriate amount of specimen preservation solution such as formalin further needs to be poured into the cup, so that the specimen is fully immersed in the specimen preservation solution, and then the cover body is screwed with the cup, to seal the opening at the top of the cup. However, when an operator opens the cover body of the container of the specimen preservation solution and then pours the specimen preservation solution into the cup, both hands of the operator are usually stained with the specimen preservation solution such as formalin, a preservative. Frequent contact between the specimen preservation solution with human skins causes harm to health. In addition, it is not easy to perfectly control the dose of the poured specimen preservation solution. If the dose is excessive, waste is caused, and if the dose is insufficient, the specimen cannot be fully immersed in the specimen preservation solution. Apparently, it is learned that it is not practical or convenient to contain or preserve a specimen by using a common cup with a cover body. Further research, development, and improvement are needed.

SUMMARY

The main objective of the present invention is to provide a drug mixing container. An inner peripheral wall of the container includes a piercing structure protruding toward an opening of the container. When an opening of a cover body is coupled downward to the container, a tip portion of the piercing structure may pierce and tear a sealing film of the cover body, so that a particular dose of specimen preservation solution in the cover body can flow into the container, and hands of an operator can be prevented from being stained with the specimen preservation solution.

To achieve the foregoing objective, a drug mixing container of the present invention comprises a container with an opening facing upward and a cover body, wherein an inner peripheral wall of the container comprises at least one piercing structure protruding toward the opening of the container, the cover body has an opening toward the container and accommodates a drug, and the opening of the cover body comprises a sealing film for sealing the drug in the cover body; and in use, when the opening of the cover body is coupled downward to the opening of the container, the sealing film is pierced and torn by the piercing structure to make the drug in the cover body flow into the container.

Optionally, an outer periphery of the container adjacent to the cover body comprises an external thread, a convex edge is disposed in an outward-expanding manner on the cover body adjacent to the container, an inner wall surface of the convex edge comprises an internal thread, and the internal thread is screwed with the external thread of the container.

Optionally, a convex ring is disposed in an outward-expanding manner on the container adjacent to the cover body, the external thread is disposed on an outer periphery of the convex ring, the convex ring and the inner peripheral wall of the container form an inner retaining edge, an outer retaining edge is disposed on a bottom of the external thread in an outward-expanding manner, an inner ring wall stretches from the cover body toward the container, a gap is disposed between the convex edge and the inner ring wall, the gap accommodates the convex ring, the inner ring wall abuts against the inner retaining edge of the container, the convex edge abuts against the outer retaining edge of the container, and the piercing structure protrudes from the inner retaining edge.

Optionally, a top end of the piercing structure toward the opening of the container comprises a bevel, one side of the bevel has a triangular tip portion, and the tip portion is inclined downward toward an other side to form the bevel.

Optionally, the inner peripheral wall of the container adjacent to the cover body comprises an internal thread, the inner peripheral wall of the container equidistantly and annularly comprises four piercing structures protruding from the inner peripheral wall of the container, the cover body adjacent to the container is recessed inward to form an inner ring, and an outer peripheral wall of the inner ring comprises an external thread screwed with the internal thread of the container.

Optionally, a top end of the piercing structure toward the cover body comprises a bevel, one side of the bevel has a triangular tip portion, and the tip portion is inclined downward toward an other side to form the bevel.

Optionally, the cover body adjacent to the container is recessed inward to form an inner ring, the inner ring encircles to form the opening of the cover body, and the inner ring is inserted downward into the opening at a top of the container.

In this way, when the opening of the cover body is coupled downward to the opening of the container, the tip portion of the piercing structure may pierce and tear the sealing film, so that a particular dose of drug in the cover body flows into the container, and hands of an operator are prevented from being stained with the drug.

DETAILED DESCRIPTION

Figure 1:
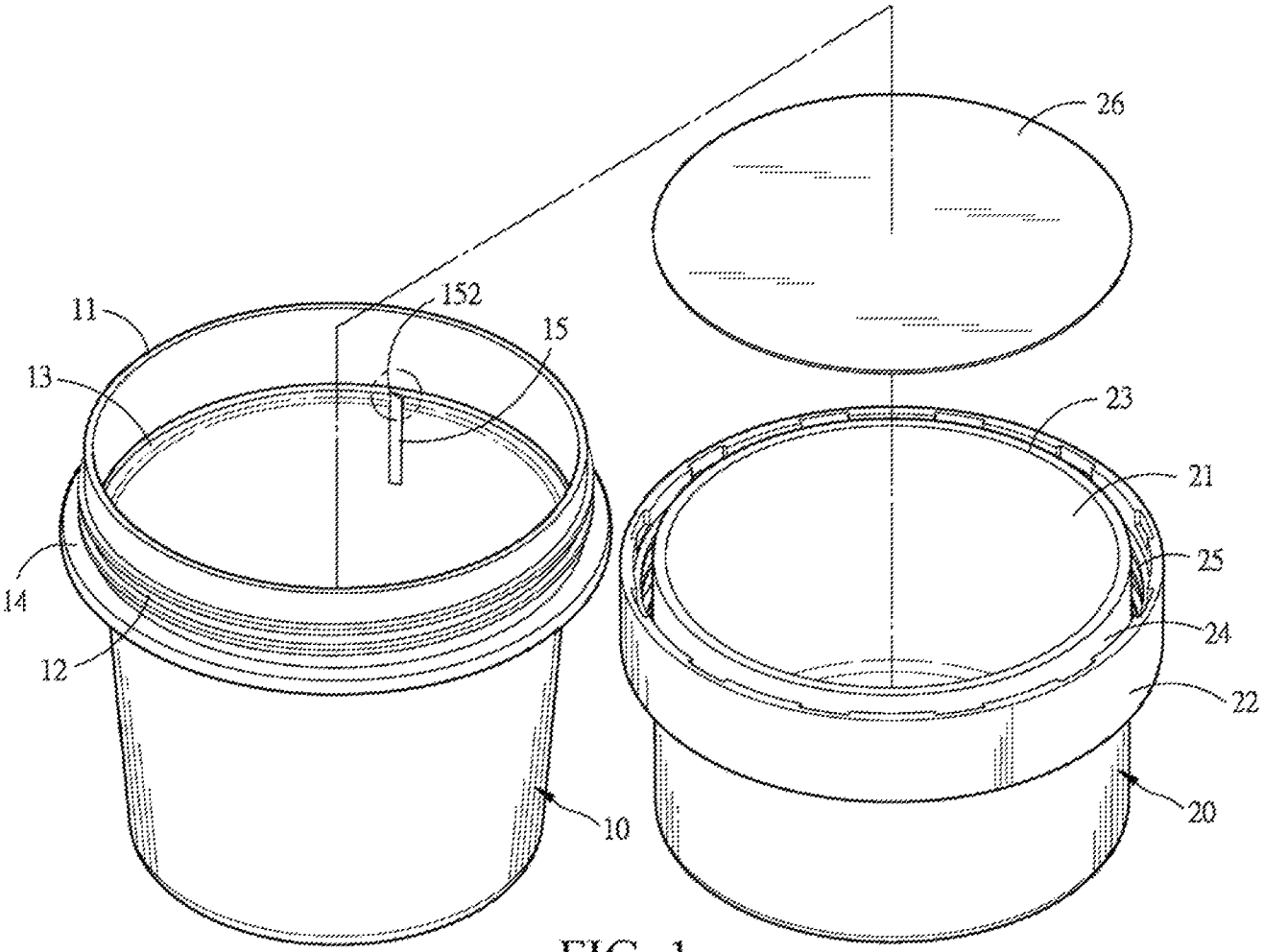
FIG. 1 is an exploded stereogram of a first embodiment of the present invention.
Figure 1A:
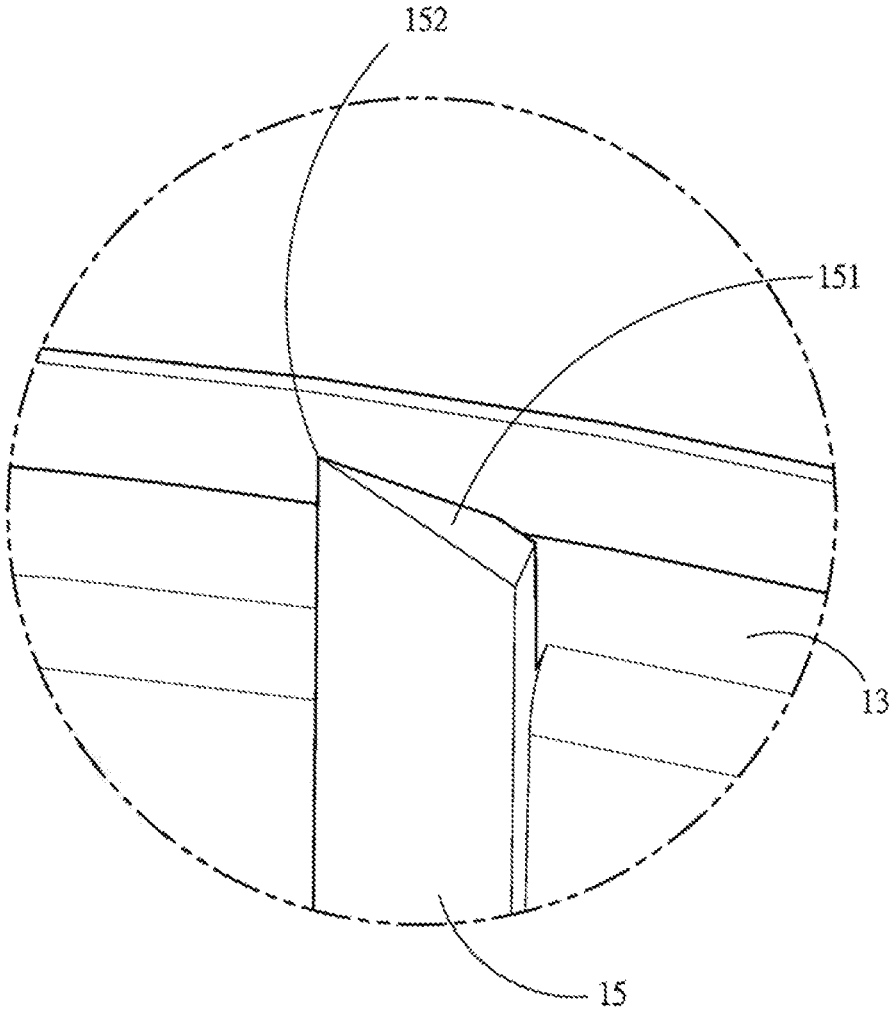
FIG. 1A is a partial enlarged view of FIG. 1.
Figure 2:
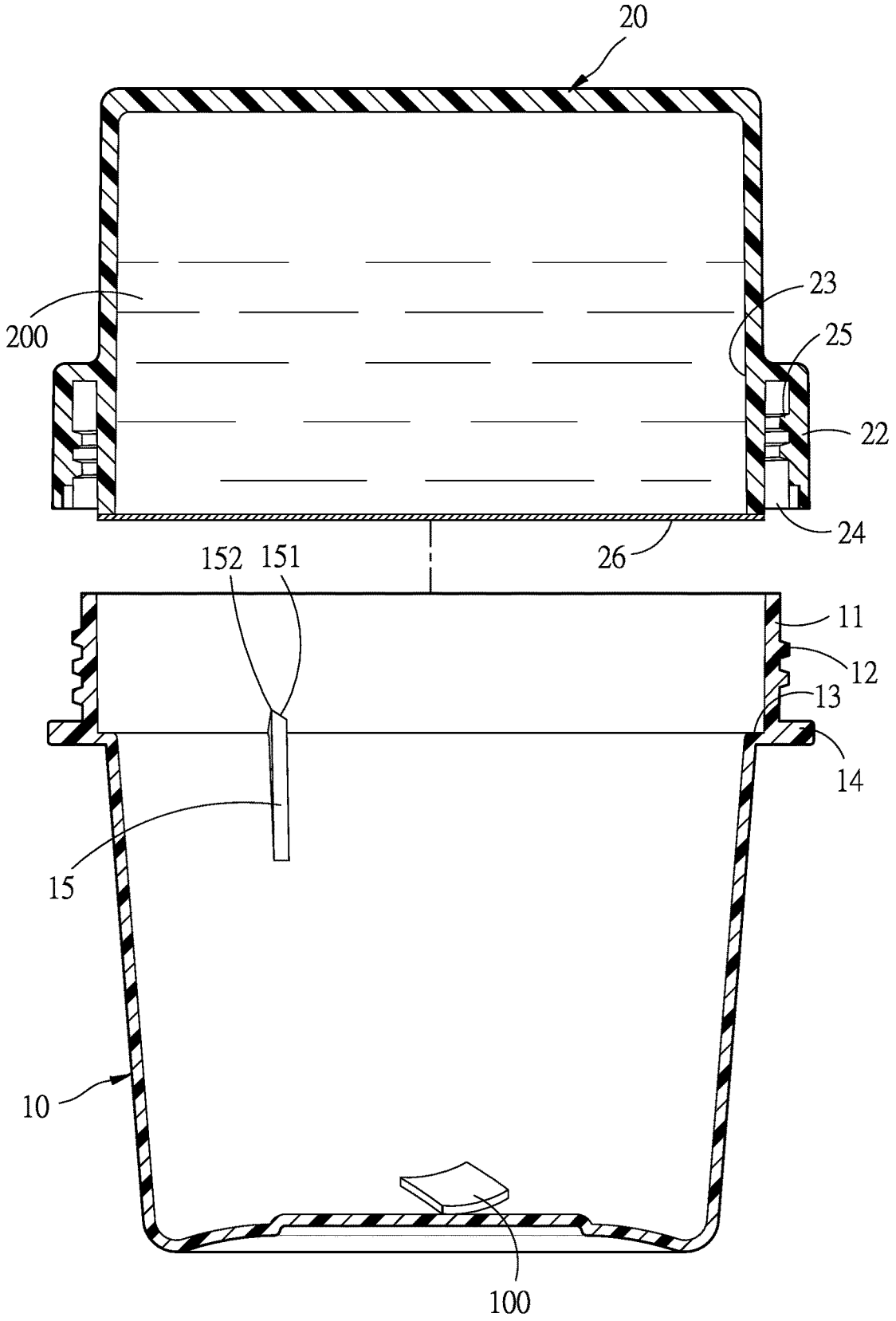
FIG. 2 is a schematic cross-sectional view of the first embodiment of the present invention.
Figure 3:
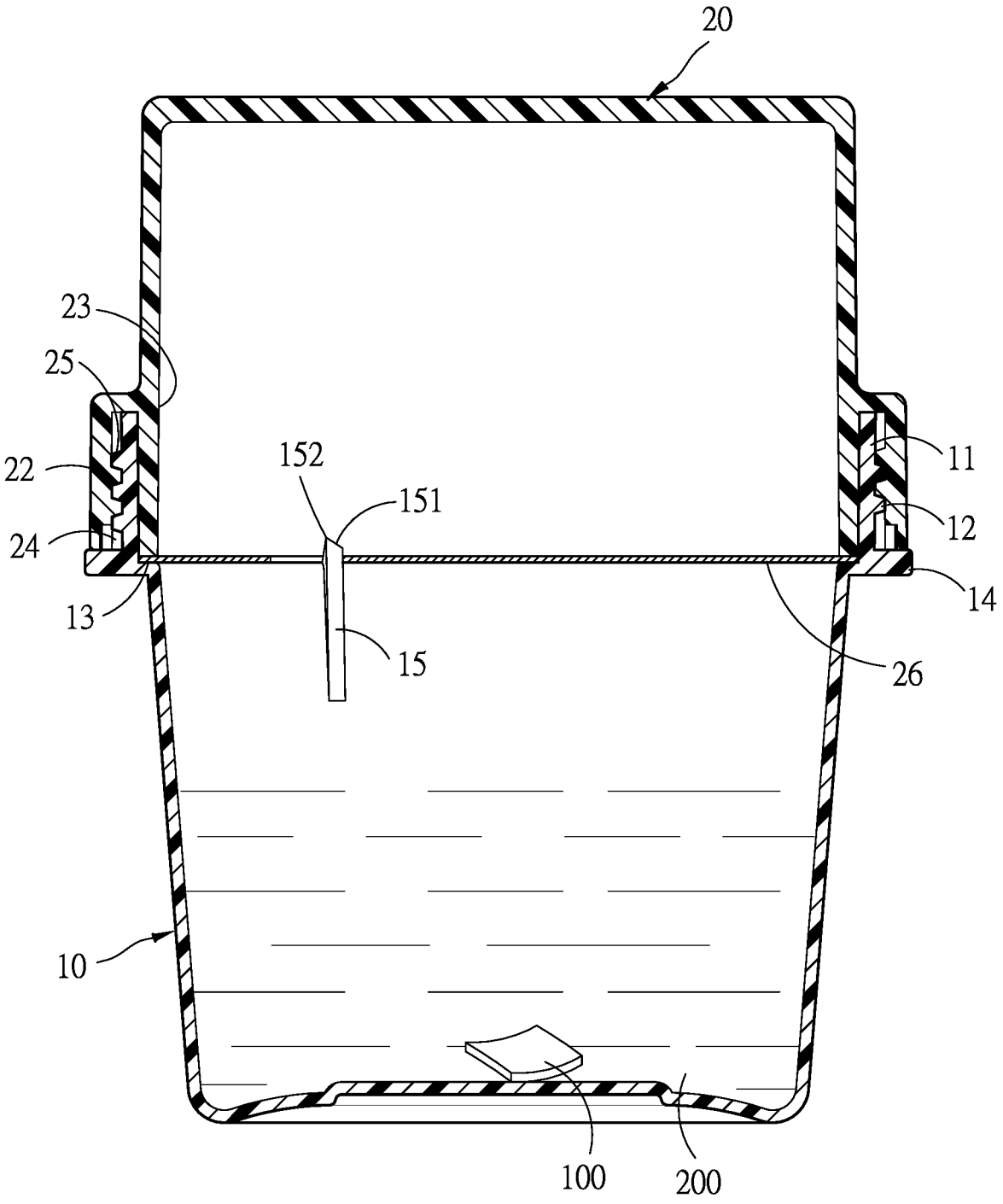
FIG. 3 is a cross-sectional assembled view of the first embodiment of the present invention.

The present invention will be further described below with reference to the accompanying drawings and specific embodiments, and thus better understood and implemented by those skilled in the art. However, the listed embodiments are not intended to limit the present invention.

FIG. 1, FIG. 1A, FIG. 2, and FIG. 3 show a first embodiment of a drug mixing container of the present invention. The drug mixing container includes a container 10 with an opening facing upward and a cover body 20. The cover body 20 and the container 10 are screwed together by a thread. In this embodiment, the container 10 is used to contain a specimen 100. A convex ring 11 is disposed in an outward-expanding manner on the container 10 adjacent to the cover body 20. An external thread 12 is disposed on an outer periphery of the convex ring 11. The convex ring 11 and an inner peripheral wall of the container 10 form an inner retaining edge 13. An outer retaining edge 14 is disposed on a bottom of the external thread 12 in an outward-expanding manner. The inner peripheral wall of the container 10 includes a piercing structure 15 protruding toward the opening of the container 10, and a top end of the piercing structure 15 toward the cover body 20 includes a bevel 151. One side of the bevel 151 has a triangular tip portion 152. The tip portion 152 is inclined downward toward the other side to form the bevel 151. The tip portion 152 protrudes from the inner retaining edge 13 and stretches into an internal space of the cover body 20.

The cover body 20 has an opening 21 toward the container 10. A convex edge 22 is disposed in an outward-expanding manner on the cover body 20 adjacent to the container 10. An inner ring wall 23 stretches from the cover body 20 toward the container 10. An annular gap 24 is disposed between the convex edge 22 and the inner ring wall 23. The gap 24 accommodates the convex ring 11. An inner wall surface of the convex edge 22 includes an internal thread 25 screwed with the external thread 12 of the container 10. The inner ring wall 23 abuts against the inner retaining edge 13 of the container 10. The convex edge 22 abuts against the outer retaining edge 14 of the container 10. The cover body 20 accommodates a drug. In this embodiment, the drug is a specimen preservation solution 200 for preserving a specimen such as formalin, a preservative. The opening 21 of the cover body 20 is sealed by a sealing film 26 such as a tin foil adhesive film. When the cover body 20 is rotationally screwed with the container 10, the tip portion 152 of the piercing structure 15 may pierce and tear the sealing film 26 with the rotation of the cover body 20, so that the specimen preservation solution 200 in the cover body 20 flows into the container 10, and further the specimen 100 in the container 10 is immersed in the specimen preservation solution 200, thereby preventing hands of the operator from being stained with the specimen preservation solution 200 such as formalin.

In addition, if the present invention is used to detect hemoglobin in faeces, the drug may be accommodated in the cover body 20 as a test reagent. The opening 21 of the cover body 20 is sealed by the sealing film 26. The container 10 contains faeces to be detected. When the cover body 20 is rotationally screwed with the container 10, the tip portion 152 of the piercing structure 15 may pierce and tear the sealing film 26 with the rotation of the cover body 20, so that the test reagent in the cover body 20 flows into the container 10 for performing a process of detecting hemoglobin contained in the faeces.

Certainly, the cover body 20 of the present invention may also contain pure water. The container 10 may contain detection drug powder. When the cover body 20 is rotationally screwed with the container 10, the tip portion 152 of the piercing structure 15 may pierce and tear the sealing film 26 with the rotation of the cover body 20, so that the water in the cover body 20 flows into the container 10, and the container is shaken to mix the water with the detection drug powder to form a detection standard solution for use.

Figure 4:
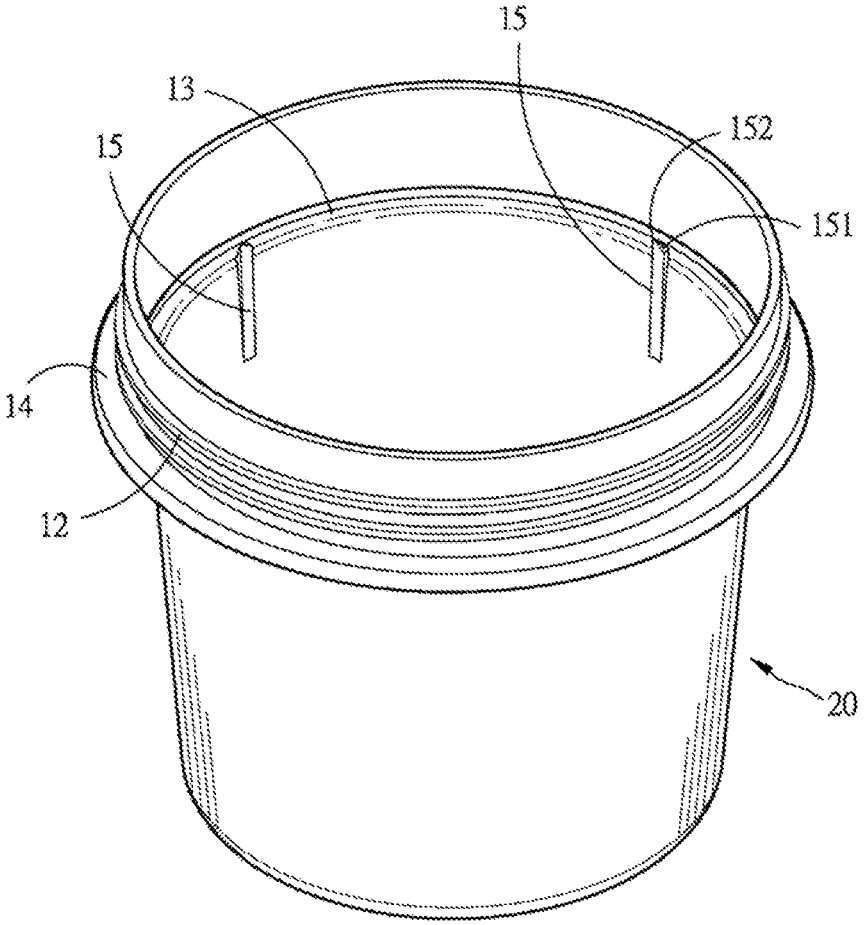
FIG. 4 is a stereogram of a container according to a second embodiment of the present invention.
Figure 5:
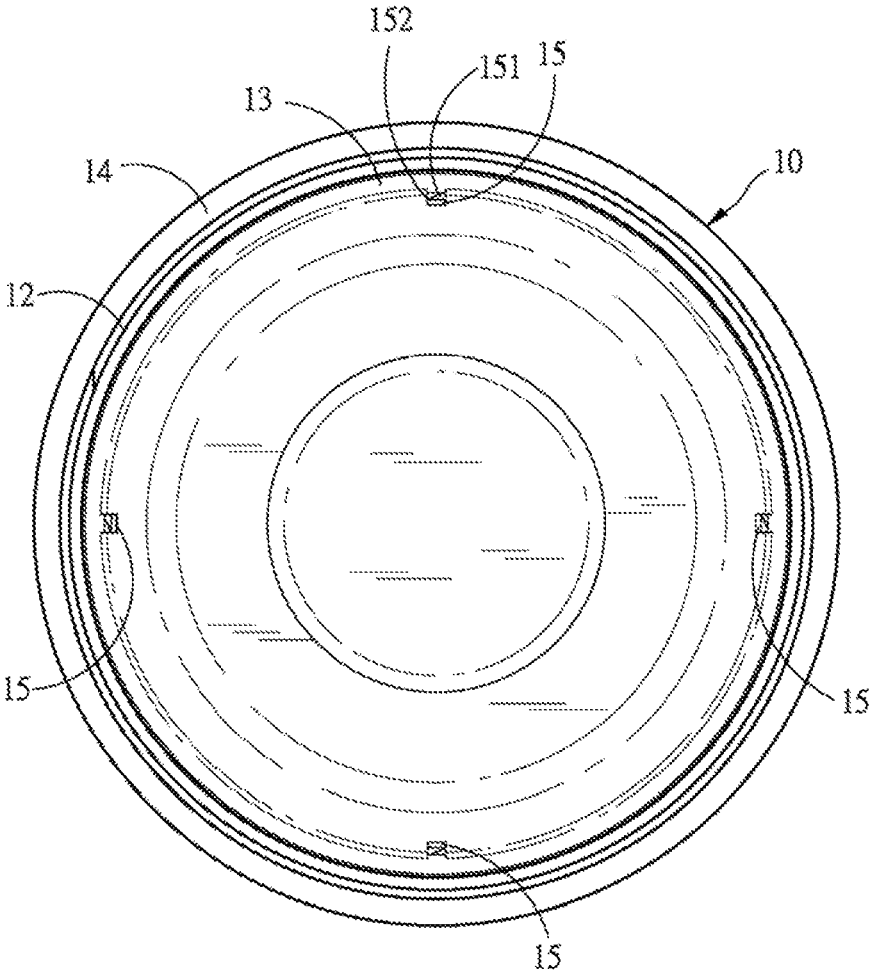
FIG. 5 is a top view of the container according to the second embodiment of the present invention.

FIG. 4 and FIG. 5 show a second embodiment of a drug mixing container of the present invention. The second embodiment is substantially the same as the first embodiment except that the inner peripheral wall of the container 10 includes four piercing structures 15 protruding toward the opening of the container 10. A top end of the piercing structure 15 toward the cover body 20 includes a bevel 151 (reference may be made to FIG. 1 and FIG. 1A). One side of the bevel 151 has a triangular tip portion 152. The tip portion 152 is inclined downward toward the other side to form the bevel 151. The tip portion 152 protrudes from the inner retaining edge 13 and stretches into an internal space of the cover body 20.

Figure 6:
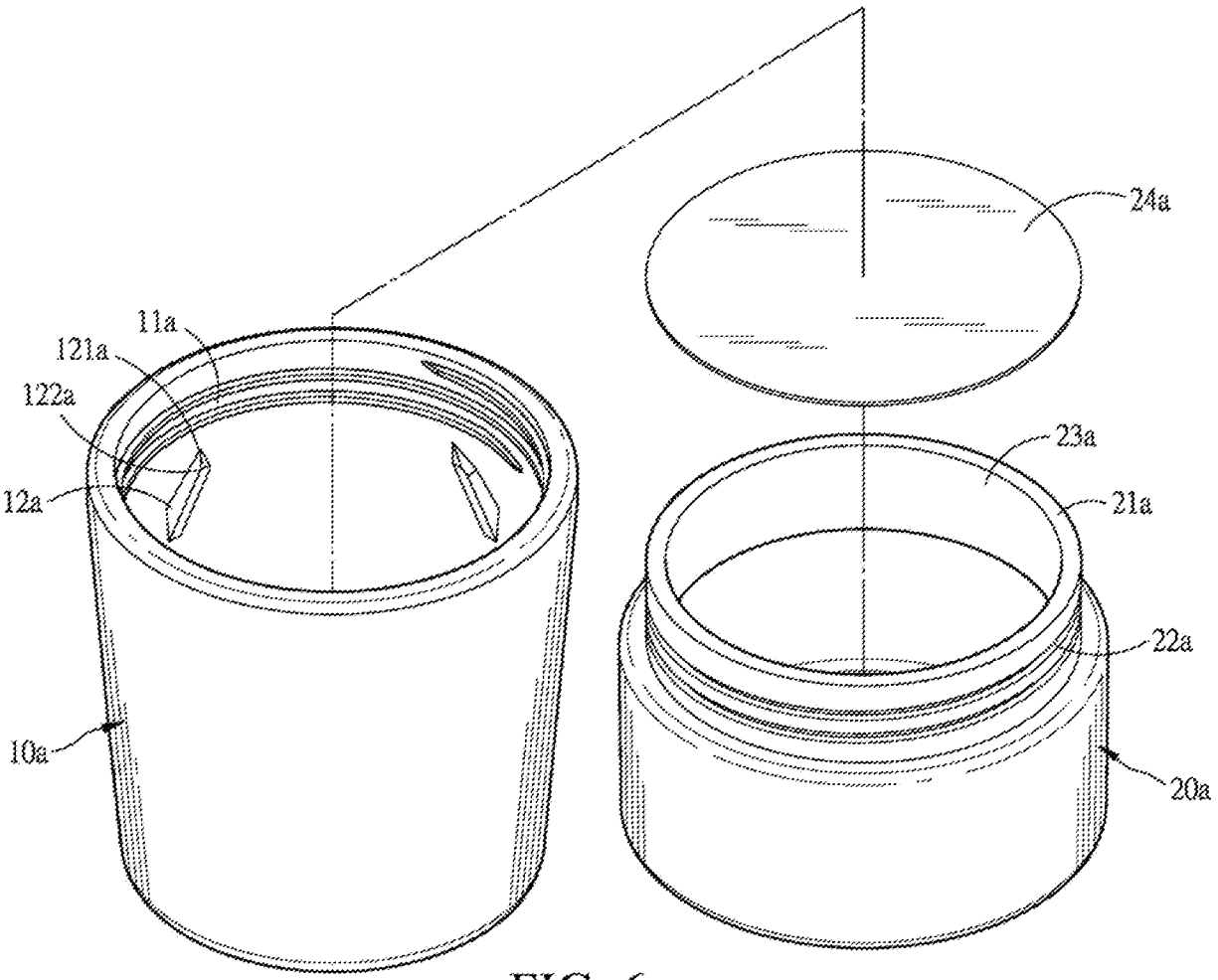
FIG. 6 is an exploded stereogram of a third embodiment of the present invention.
Figure 7:
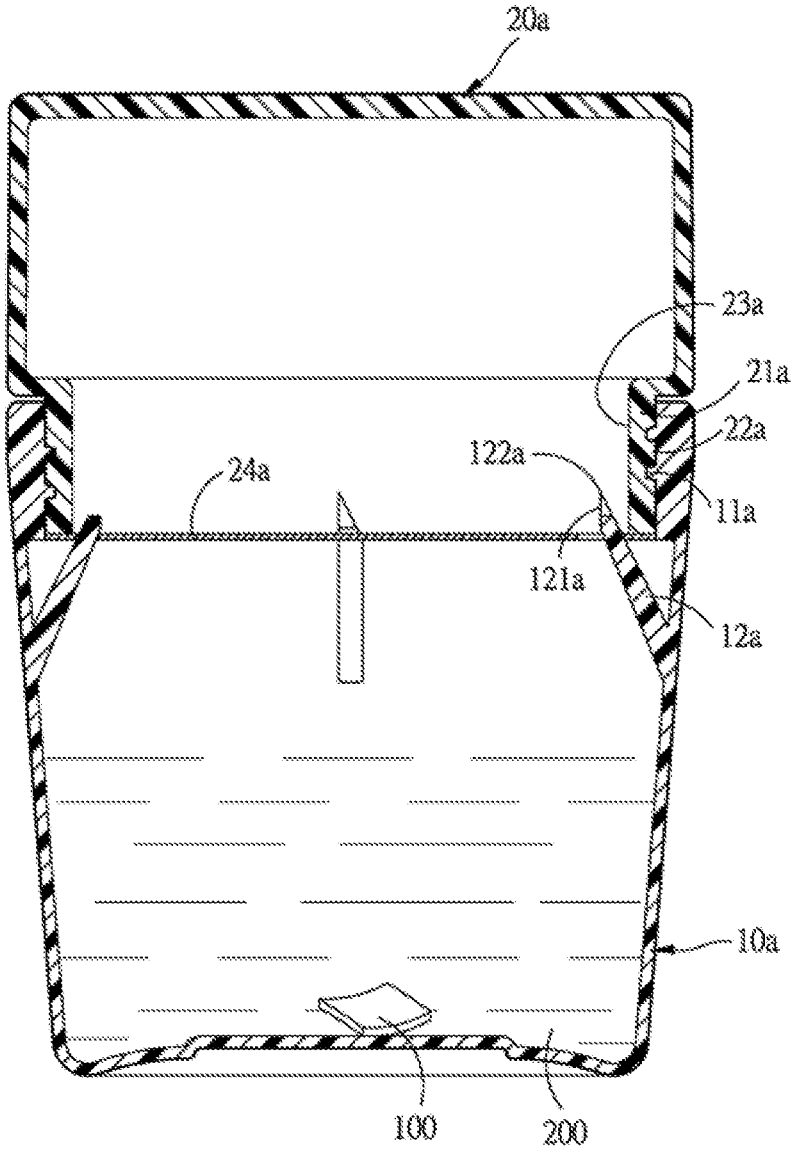
FIG. 7 is a cross-sectional assembled view of the third embodiment of the present invention.

FIG. 6 and FIG. 7 show a third embodiment of a drug mixing container of the present invention. The third embodiment is substantially the same as the first embodiment. The drug mixing container includes a container 10*a* with an opening facing upward and a cover body 20*a*. The inner peripheral wall of the container 10*a* adjacent to the cover body 20*a* includes an internal thread 11*a*. The inner peripheral wall of the container 10*a* equidistantly and annularly includes four piercing structures 12*a* protruding toward the opening of the container 10*a*. A top end of the piercing structure 12*a* toward the cover body 20*a* includes a bevel 121*a*. One side of the bevel 121*a* has a triangular tip portion 122*a*. The tip portion 122*a* is inclined downward toward the other side to form the bevel 121*a*. The tip portion 122*a* stretches into an internal space of the cover body 20*a*.

The cover body 20*a* adjacent to the container 10*a* is recessed inward to form an inner ring 21*a*. An outer peripheral wall of the inner ring 21*a* includes an external thread 22*a* screwed with the internal thread 11*a* of the container 10*a*. The cover body 20*a* accommodates a drug. The drug is a specimen preservation solution 200 such as formalin, a preservative. An opening 23*a* of the cover body 20*a* is sealed by a sealing film 24*a* such as a tin foil adhesive film.

In this way, when the cover body 20*a* is rotationally screwed with the container 10*a*, the tip portion 122*a* of the piercing structure 12*a* may pierce and tear the sealing film 24*a* with the rotation of the cover body 20*a*, so that the specimen preservation solution 200 in the cover body 20*a* flows into the container 10*a*, and further the specimen 100 in the container 10*a* is immersed in the specimen preservation solution 200, thereby preventing hands of the operator from being stained with the specimen preservation solution 200 such as formalin.

Figure 8:
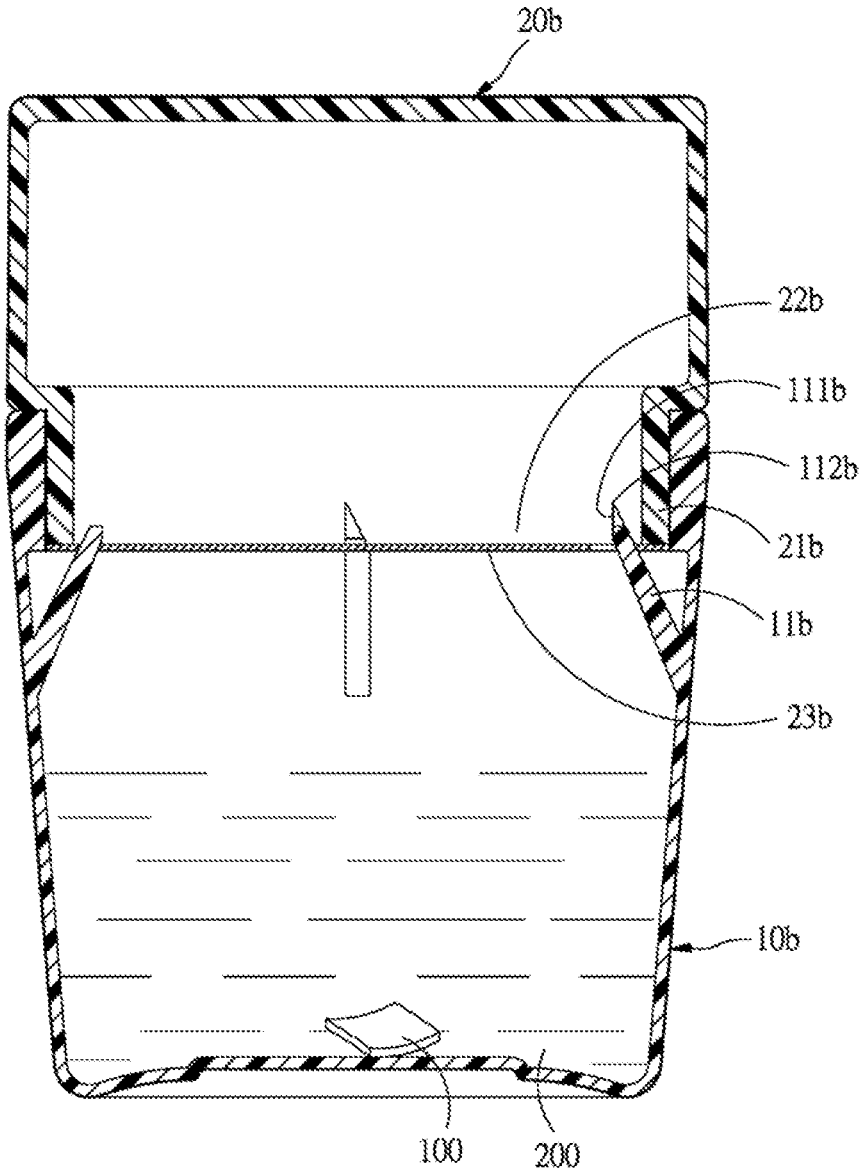
FIG. 8 is a cross-sectional assembled view of a fourth embodiment of the present invention.

FIG. 8 shows a fourth embodiment of a drug mixing container of the present invention. The drug mixing container generally includes a container 10*b* with an opening facing upward and a cover body 20*b*. In this embodiment, an inner peripheral wall of the container 10*b* equidistantly and annularly includes four piercing structures 11*b* protruding toward the opening of the container 10*b*. A top end of the piercing structure 11*b* toward the cover body 20*b* includes a bevel 111*b*. One side of the bevel 111*b* has a triangular tip portion 112*b*. The tip portion 112*b* is inclined downward toward the other side to form the bevel 111*b*. The tip portion 112*b* stretches into an internal space of the cover body 20*b*.

The cover body 20*b* adjacent to the container 10*b* is recessed inward to form an inner ring 21*b*. The inner ring 21*b* encircles to form an opening of the cover body 20*b*. The inner ring 21*b* is inserted into the opening at the top of the container 10*b*. The cover body 20*b* accommodates a specimen preservation solution 200 such as formalin, a preservative. The opening 22*b* of the cover body 20*b* is sealed by a sealing film 23*b* such as a tin foil adhesive film.

In this way, when the inner ring 21*b* of the cover body 20*b* is inserted into the opening of the container 10*b* and then rotated by an angle, the tip portion 112*b* of the piercing structure 11*b* may pierce and tear the sealing film 23*b*, so that the specimen preservation solution 200 in the cover body 20*b* flows into the container 10*b*, thereby making the specimen 100 in the container 10*b* immersed in the specimen preservation solution 200.

The embodiments described above are merely preferred embodiments for the purpose of fully illustrating the present invention, and the scope of protection of the present invention is not limited thereto. Equivalent substitutions or modifications made by those skilled in the art based on the present invention are within the scope of protection of the present invention. The scope of protection of the present invention is defined by the claims.

What is claimed is:

1. A drug mixing container, comprising a container with an opening facing upward and a cover body, wherein an inner peripheral wall of the container comprises at least one piercing structure protruding toward the opening of the container, the cover body has an opening toward the container for accommodating a drug, and the opening of the cover body comprises a sealing film for sealing the drug in the cover body;

wherein an outer periphery of the container adjacent to the cover body comprises an external thread, a convex edge is disposed in an outward-expanding manner on the cover body adjacent to the container, an inner wall surface of the convex edge comprises an internal thread, and the internal thread is screwed with the external thread of the container;

wherein a convex ring is disposed in an outward-expanding manner on the container adjacent to the cover body, the external thread is disposed on an outer periphery of the convex ring, the convex ring and the inner peripheral wall of the container form an inner retaining edge, an outer retaining edge is disposed on a bottom of the external thread in an outward-expanding manner, an inner ring wall stretches from the cover body toward the container, a gap is disposed between the convex edge and the inner ring wall, the gap accommodates the convex ring, the inner ring wall abuts against the inner retaining edge of the container, the convex edge abuts against the outer retaining edge of the container, and the piercing structure protrudes from the inner retaining edge.

2. The drug mixing container according to claim 1, wherein a top end of the piercing structure toward the opening of the container comprises a bevel, one side of the bevel has a triangular tip portion, and the tip portion is inclined downward toward an other side to form the bevel.

* * * * *